US008197917B2

(12) United States Patent
Wang

(10) Patent No.: US 8,197,917 B2
(45) Date of Patent: Jun. 12, 2012

(54) DECORATION

(76) Inventor: Chi-Min Wang, Rende Township, Tainan County (TW)

( * ) Notice: Subject to any disclaimer, the term of this patent is extended or adjusted under 35 U.S.C. 154(b) by 179 days.

(21) Appl. No.: 12/856,772

(22) Filed: Aug. 16, 2010

(65) Prior Publication Data

US 2012/0040108 A1 Feb. 16, 2012

(51) Int. Cl.
*A47G 33/08* (2006.01)
*A47G 33/00* (2006.01)
*A63H 33/08* (2006.01)

(52) U.S. Cl. ..... 428/8; 428/11; 273/160; 446/115; 446/116; 446/124

(58) Field of Classification Search ..... 428/4, 5, 428/7, 8, 9, 11, 12, 542.2; D11/121; 273/160; 446/115, 116, 124
See application file for complete search history.

(56) References Cited

U.S. PATENT DOCUMENTS 927,499 A * 7/1909 Davis ..... 434/214
1,695,307 A * 12/1928 Bird ..... 362/121
2,067,527 A * 1/1937 Greene ..... 428/8
2,783,046 A * 2/1957 Lien ..... 473/596
3,790,175 A * 2/1974 Ragnow ..... 273/160
4,335,165 A * 6/1982 Powers ..... 428/8
4,596,726 A * 6/1986 Wrzalinski ..... 428/11
D390,807 S * 2/1998 Otto ..... D11/121
6,439,945 B1 * 8/2002 Liu ..... 446/71
D527,302 S * 8/2006 Vladamirov ..... D11/121
2009/0035487 A1 * 2/2009 Chen ..... 428/7

* cited by examiner

*Primary Examiner* — Aaron Austin
(74) *Attorney, Agent, or Firm* — Alan Kamrath; Kamrath IP Lawfirm, PA

(57) ABSTRACT

A decoration includes a first, lower decoration member and a second, lower decoration member detachably connected to the first, lower decoration member. Each lower decoration member includes a lower main body having first and second lower branch portions and a lower engaging slot in an upper end thereof. The decoration further includes at least one upper decoration member. The upper decoration member includes an upper main body having first and second upper branch portions and an upper engaging slot in a lower end thereof. The lower engaging slots of the first and second lower decoration members are engaged with the upper decoration member, and the upper engaging slot of the upper decoration member is engaged with the first and second lower decoration members. The decoration can be quickly assembled and exhibit a rich visional appearance.

10 Claims, 7 Drawing Sheets

DECORATION

BACKGROUND OF THE INVENTION

1. Field of the Invention

The present invention relates to a decoration and, more particularly, to a Christmas decoration, house decoration or hanging decoration that has a rich visional appearance.

2. Description of the Related Art

Decorations such as the Christmas decorations used in Christmas period can add good looking to home environment and can add more viewing atmosphere to the happy holiday period.

FIGS. 1 and 2 show a conventional decoration 10 including a main piece 12 and a plurality of branch pieces 14. The main piece 12 includes upper and lower ends 16 and 18 spaced in a vertical direction. A plurality of engaging holes 20 are respectively provided in the upper end 16 and the lower end 18. Each branch piece 14 includes upper and lower ends 24 and 26 spaced in the vertical direction. The upper end 24 of each branch piece 14 is inserted into one of the engaging holes 20 of the upper end 16 of the main piece 12, and the lower end 26 of each branch piece 14 is inserted into one of the engaging holes 20 of the lower end 18 of the main piece 12 so that the branch pieces 14 are mounted around a periphery of main piece 12 to form a lantern shaped decoration. Moreover, a ring 22 is formed on the upper end 16 of the main piece 12 to provide hanging purpose, and the decoration 10 can then be used as a hanging decoration. Although decoration 10 can be detachably assembled and provide vision of a lantern form, yet decoration 10 does not provide convenient assembly, that is, the assembly of decoration 10 is time-consuming and mass production is difficult. In addition, the appearance of decoration 10 is not rich, and the viewer could easily feel bored on it.

BRIEF SUMMARY OF THE INVENTION

Therefore, it is an objective of the present invention to overcome the aforementioned shortcoming and deficiency of the prior art by providing a decoration which has advantages such as ease of assembly and disassembly to facilitate mass production and the possession of a rich visional appearance. Hence, the viewing value of the decoration can be enhanced.

To achieve the foregoing objective, a decoration of the present invention includes a lower decoration unit and an upper decoration unit. The lower decoration unit includes first and second, lower decoration members each including a lower main body having upper and lower ends spaced in a vertical direction. The lower main body further includes first and second surfaces spaced in a thickness direction perpendicular to the vertical direction, and two side surfaces spaced in a horizontal direction perpendicular to the vertical and thickness directions. The lower main body further includes a lower engaging slot extending from the upper end of the lower main body toward but spaced from the lower end of the lower main body so that the upper end of the lower main body is formed with two spaced clamp walls. The first surface of the lower main body of the first lower decoration member is detachably connected to the first surface of the lower main body of the second lower decoration member. Each lower decoration member further includes at least one first lower branch portion extending outwards from one of the side surfaces of the lower main body. The upper decoration unit includes an upper decoration member having upper and lower ends spaced in the vertical direction, first and second surfaces spaced in the thickness direction, and two side surfaces spaced in the horizontal direction. The upper main body further includes an upper engaging slot extending from the lower end of the upper main body toward but spaced from the upper end of the upper main body so that the lower end of the upper main body is formed with two spaced clamp walls. The upper decoration member further includes at least one first upper branch portion extending outwards from one of the side surfaces of the upper main body. The clamp walls of the upper decoration member clamp on the second surfaces of the lower main bodies of the first and second lower decoration members, and the clamp walls of the first and second lower decoration members clamp on the first and second surfaces of the upper main bodies of the upper decoration member.

In a preferred form, the first surface of each of the first and second lower decoration members is provided with male and female engaging portions located between the lower end and the lower engaging slot of the lower main body of each of the first and second lower decoration members. The male and female engaging portions of the first lower decoration member are respectively aligned and engaged with the female and male engaging portions of the second lower decoration member.

In a preferred form, each of the first and second lower decoration members further includes at least one second lower branch portion extending outwards from the lower main body and located at an external side of the first lower branch portion, and the upper decoration member further includes at least one second upper branch portion extending outwards from the upper main body in the horizontal direction.

The present invention will become clearer in light of the following detailed description of illustrative embodiments of this invention described in connection with the drawings.

DESCRIPTION OF THE DRAWINGS

The illustrative embodiments may best be described by reference to the accompanying drawings where.

DETAILED DESCRIPTION OF THE INVENTION

Figure 2:
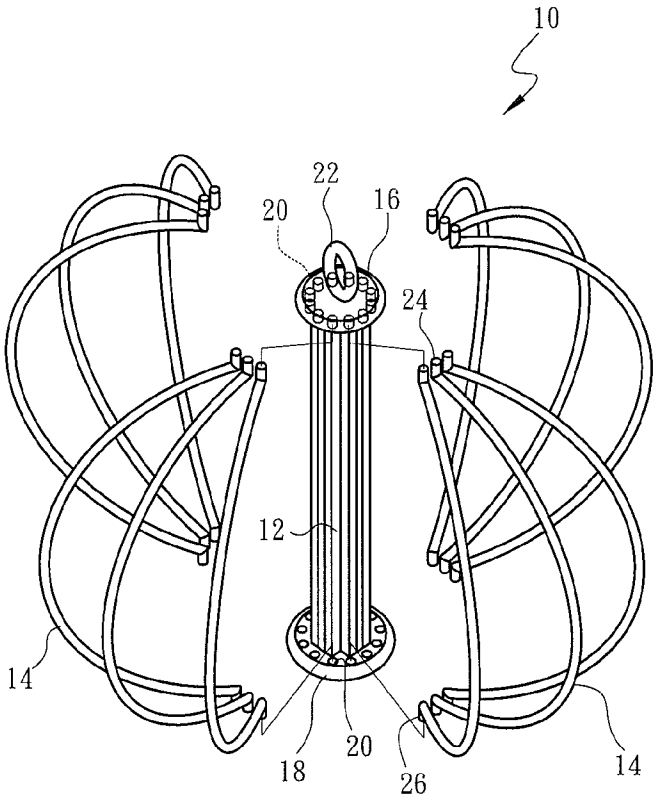
FIG.2 Prior Art
FIG. 2 is an exploded perspective view of the decoration of FIG. 1.
Figure 1:
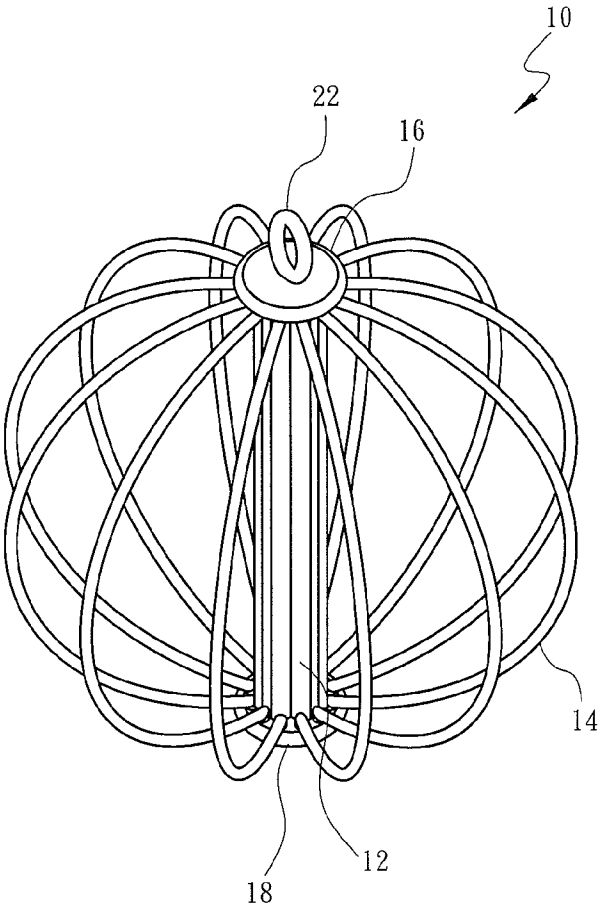
FIG.1 Prior Art
FIG. 1 shows a perspective view of a conventional decoration.
Figure 4:
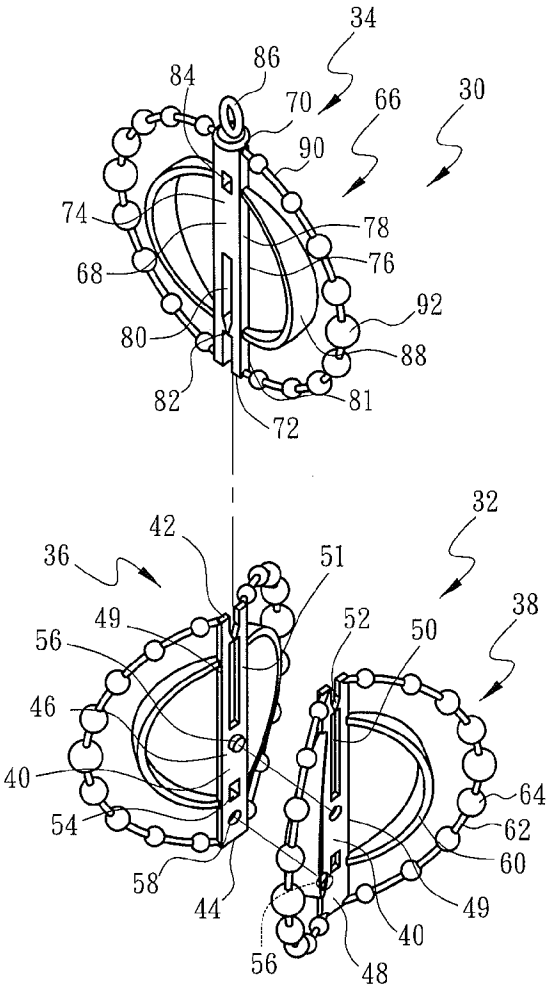
FIG. 4 is an exploded perspective view of the decoration of FIG. 3.
Figure 3:
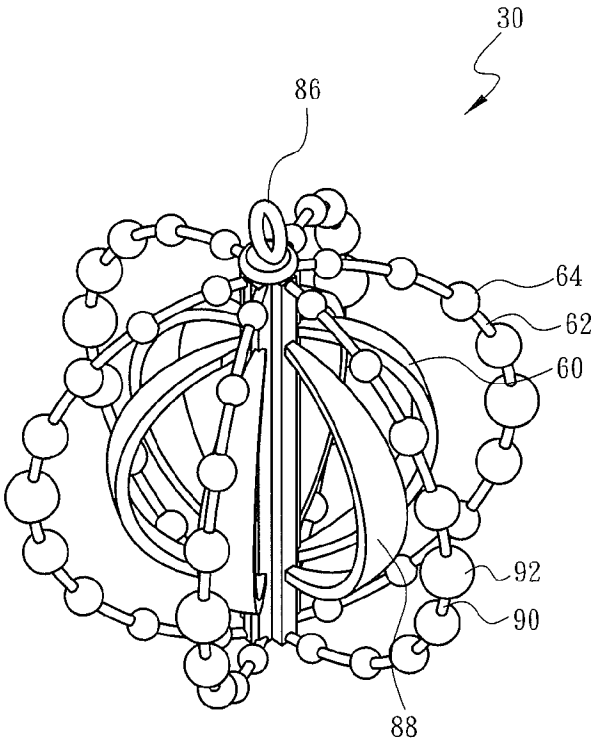
FIG. 3 shows a perspective view of a decoration according to a first embodiment of the present invention.
Figure 5:
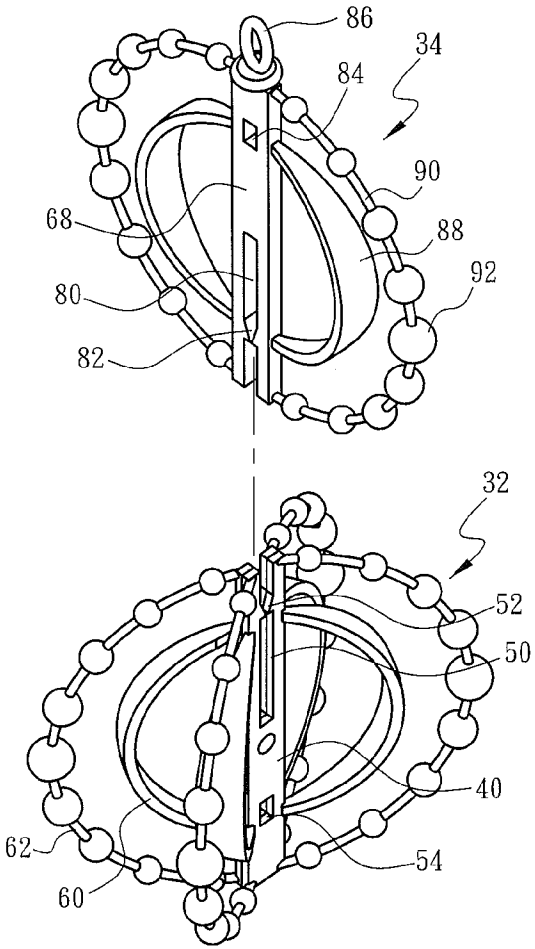
FIG. 5 is a partially exploded perspective view of the decoration of FIG. 3.

A decoration of a first embodiment of the present invention is shown in FIGS. 3 through 5 of the drawings and generally designated 30. The decoration 30 includes a lower decoration unit 32 and an upper decoration unit 34.

According to the preferred form shown, lower decoration unit 32 includes a first lower decoration member 36 and a second lower decoration member 38. Each lower decoration member 36, 38 includes a lower main body 40 having upper and lower ends 42 and 44 spaced in a vertical direction. Lower main body 40 further includes first and second surfaces 46 and 48 spaced in a thickness direction perpendicular to the vertical direction, and two side surfaces 49 spaced in a horizontal direction perpendicular to the vertical and thickness directions. A lower engaging slot 50 is provided in lower main body 40 and extended from upper end 42 toward but spaced from lower end 44 so that upper end 42 is formed with two spaced clamp walls 51. In this embodiment, lower engaging slot 50 extends from upper end 42 to a middle of lower main body 40. Each clamp wall 51 includes an inner surface provided with a locking block 52. Lower main body 40 further includes a locking slot 54 located between the lower end 44 of lower main body 40 and lower engaging slot 50. Furthermore, lower main body 40 of each lower decoration member 36, 38 is provided with at least one engaging portion by which the first surface 46 of first lower decoration member 36 can be detachably connected with first surface 46 of second lower decoration member 38. In this embodiment, the first surfaces 46 of first and second lower decoration members 36 and 38 are respectively provided with a male engaging portion (protruding peg) 56 and a female engaging portion (through-hole) 58. Male and female engaging portions 56 and 58 are separately located between lower end 44 of lower main body 40 and lower engaging slot 50. Moreover, male and female engaging portions 56 and 58 of first lower decoration member 36 may be respectively aligned and connected with female and male engaging portions 58 and 56 of second lower decoration member 38.

Each lower decoration member 36, 38 further includes two first lower branch portions (inner branch portions) 60 and two second lower branch portions (external branch portions) 62. Each of first and second lower branch portions 60 and 62 is formed arc shape, and two ends of each of first and second lower branch portions 60 and 62 are integrally connected to one of the side surfaces 49 of lower main body 40, wherein first lower branch portion 60 is located at an inner side of second lower branch portion 62. A plurality of beads 64 is provided on second lower branch portion 62. Each of first and second lower branch portions 60 and 62 extends from one of the side surfaces 49 of lower main body 40 outwards and at an angle to an axis of the horizontal direction. In this embodiment, two first lower branch portions 60 are spaced by 120 degrees, and two second lower branch portions 62 are also spaced by 120 degrees. When first surface 46 of first lower decoration member 36 is connected with first surface 46 of second lower decoration member 38, one of first lower branch portions 60 of first lower decoration member 36 and an associated first lower branch portions 60 of second lower decoration member 38 are spaced by about 60 degrees, and one of second lower branch portions 62 of first lower decoration member 36 and an associated second lower branch portions 62 of second lower decoration member 38 are also spaced by about 60 degrees (see FIG. 5).

According to the preferred form shown, upper decoration unit 34 includes a first upper decoration member 66 having an upper main body 68. Upper main body 68 includes upper and lower ends 70 and 72 spaced in the vertical direction, first and second surfaces 74 and 76 spaced in the thickness direction, and two side surfaces 78 spaced in the horizontal direction. An upper engaging slot 80 is provided in upper main body 68 and extends from lower end 72 toward but spaced from upper end 70 so that lower end 72 is formed with two spaced clamp walls 81. In this embodiment, upper engaging slot 80 extends from lower end 72 to a middle of upper main body 68. Each clamp wall 81 is provided with a locking block 82 protruding from an inner surface of the clamp wall 81 and adjacent to lower end 72 of upper main body 68. Upper main body 68 further includes a locking slot 84 located between upper end 70 of upper main body 68 and upper engaging slot 80. Furthermore, a ring 86 is formed on the upper end 70 of upper main body 68 for hanging purpose.

First upper decoration member 66 includes two first upper branch portions 88 (inner branch portions) 88 and two second upper branch portions (external branch portions) 90. Each of first and second upper branch portions 88 and 90 is formed arc shape, and two ends of each of first and second, upper branch portions 88 and 90 are integrally connected to one of the side surfaces 78 of upper main body 68, wherein first upper branch portion 88 is located at an inner side of second upper branch portion 90. A plurality of beads 92 is provided on second upper branch portion 90. In this embodiment, each of first and second upper branch portions 88 and 90 extends from one of the side surfaces 78 of upper main body 68 outwards in the horizontal direction so that two first upper branch portions 88 are spaced by 180 degrees and two second upper branch portions 90 are also spaced by 180 degrees. It is apparent that first upper decoration member 66 can only include one first upper branch portion 88 and one second upper branch portion 90, or can only include two first upper branch portions 88 or two second upper branch portions 90. Each lower decoration member 36, 38 can only include one first lower branch portion 60 and one second lower branch portion 62, or can only include two first lower branch portions 60 or two second lower branch portions 62.

In assembly of decoration 30 of the present invention, the first surface 46 of first lower decoration member 36 is connected with first surface 46 of second lower decoration member 38 through engagement of male engaging portions 56 with female engaging portions 58 to form lower decoration unit 32. Next, the lower end 72 of first upper decoration member 66 is aligned with the upper ends 42 of first and second lower decoration members 36 and 38 to form intersection of 90 degrees. Then, the upper engaging slot 80 of first upper decoration member 66 receives the lower main bodies 40 of first and second lower decoration members 36 and 38, and the lower engaging slots 50 of first and second lower decoration members 36 and 38 receive upper main body 68 of first upper decoration member 66. After lower decoration unit 32 associates with upper decoration unit 34, the second surfaces 48 of first and second lower decoration members 36 and 38 are clamped by clamp walls 81 of first upper decoration member 66, and the first and second surfaces 74 and 76 of first upper decoration member 66 are clamped by clamp walls 51 of first and second lower decoration members 36 and 38. Furthermore, when the lower end 72 of first upper decoration member 66 is moved to the external side of lower ends 44 of first and second lower decoration members 36 and 38, the locking blocks 82 on the inner surfaces of the clamp walls 81 are engaged with locking slots 54 of first and second lower decoration members 36 and 38, and the locking blocks 52 on the inner surfaces of the clamp walls 51 are engaged with locking slot 84 of first upper decoration member 66, obtaining a more secure engagement. Decoration 30 provides convenience for assembly, meanwhile, its periphery possesses internally and externally corresponding six first branch portions 88 and 60 and six second branch portions 90 and 62 that are respectively spaced by 60 degrees. Hence, decoration 30 can provide a rich visional appearance.

Figure 6:
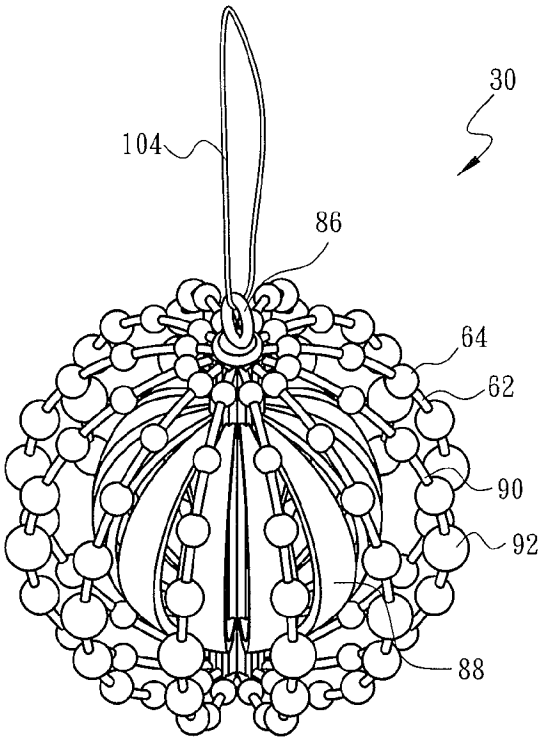
FIG. 6 shows a perspective view of a decoration according to a second embodiment of the present invention.
Figure 8:
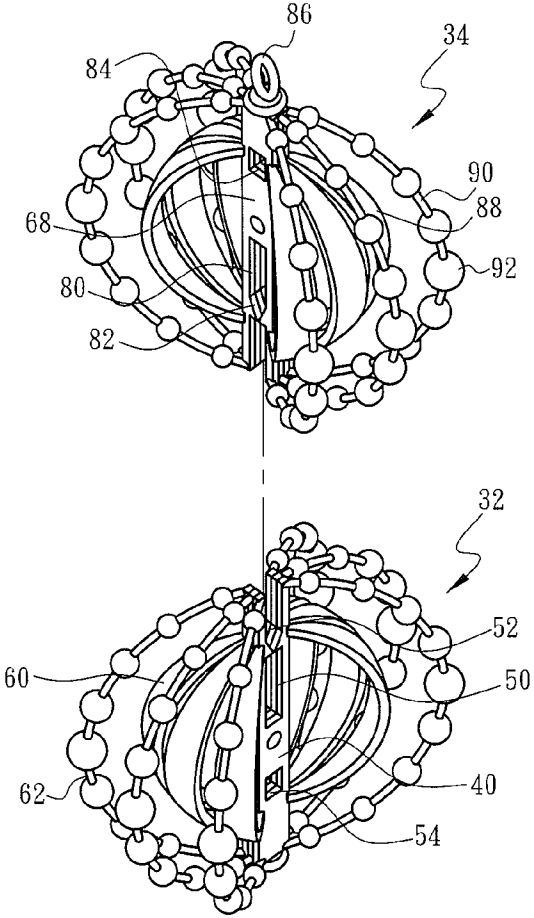
FIG. 8 is a partially exploded perspective view of the decoration of FIG. 6.
Figure 7:
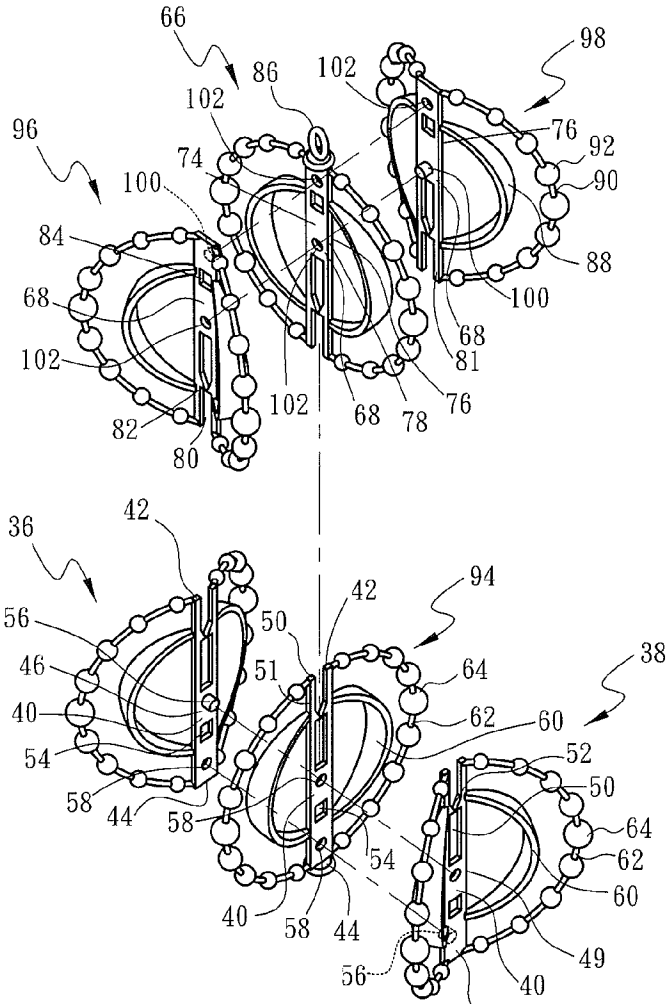
FIG. 7 is an exploded perspective view of the decoration of FIG. 6.

Referring to FIGS. 6 through 8, a decoration 30 of a second embodiment of the present invention is shown. The decoration 30 includes a lower decoration unit 32 and an upper decoration unit 34. Description of the parts of decoration 30 shown in FIGS. 6 through 8 identical to those shown in FIGS. 3 through 5 is omitted. In particular, the lower decoration unit 32 further includes a third lower decoration member 94, and the upper decoration unit 34 further includes a second upper decoration member 96 and a third upper decoration member 98. Third lower decoration member 94 is connected between first and second lower decoration members 36 and 38. The structure of third lower decoration member 94 is similar to first lower decoration member 36, that is, third lower decoration member 94 includes lower main body 40, lower engaging slot 50, clamp walls 51, locking blocks 52, locking slot 54, first lower branch portions 60, and second lower branch portions 62. The difference between first and third lower decoration members 36 and 94 is that two first lower branch portions 60 and two second lower branch portions 62 of third lower decoration member 94 extend in the horizontal direction, and third lower decoration member 94 is provided with two female engaging portions 58. In assembly aspect, male engaging portions 56 of first and second lower decoration members 36 and 38 are extended through female engaging portions 58 of third lower decoration member 94 so that first lower decoration member 36, second lower decoration member 38, and third lower decoration member 94 are combined together to form lower decoration unit 32. Second and third upper decoration members 96 and 98 are connected respectively on first and second surfaces 74 and 76 of first upper decoration member 66. The structure of each of second and third upper decoration members 96 and 98 is similar to first upper decoration member 66, that is, each of second and third upper decoration members 96 and 98 includes upper main body 68, upper engaging slot 80, clamp walls 81, locking blocks 82, locking slot 84, first upper branch portions 88 and second upper branch portions 90. The difference between each of second and third upper decoration members 96 and 98 and first upper decoration member 66 is that each of first and second upper branch portions 88 and 90 of second and third upper decoration members 96 and 98 is at an angle to the axis of the horizontal direction so that two first upper branch portions 88 of each of second and third upper decoration members 96 and 98 are spaced by 120 degrees, and two second upper branch portions 90 are also spaced by 120 degrees. In addition, each of second and third upper decoration members 96 and 98 is further provided with a male engaging portion 100 and a female engaging portion 102, and first upper decoration member 66 is provided with two female engaging portions 102 so that second and third upper decoration member 96 and 98 can be combined with first upper decoration member 66 to form upper decoration unit 34. In this embodiment, the assembly way between upper decoration unit 34 and lower decoration unit 32 is similar to that of the first embodiment. After decoration 30 is assembled, clamp walls 81 of first, second and third upper decoration members 66, 96, 98 clamp on the second surfaces 48 of first and second lower decoration members 36 and 38, and clamp walls 51 of first, second and third lower decoration members 36, 38, 94 clamp on second surfaces 76 of second and third upper decoration members 96 and 98. Furthermore, the outer periphery of decoration 30 includes internally and externally corresponding twelve first branch portions 60, 88 and twelve second branch portions 62, 90 that are respectively spaced by 30 degrees. Ring 86 of decoration 30 is connected with a hanging wire 104 to provide hanging purposes and to form a hanging decoration.

Figure 10:
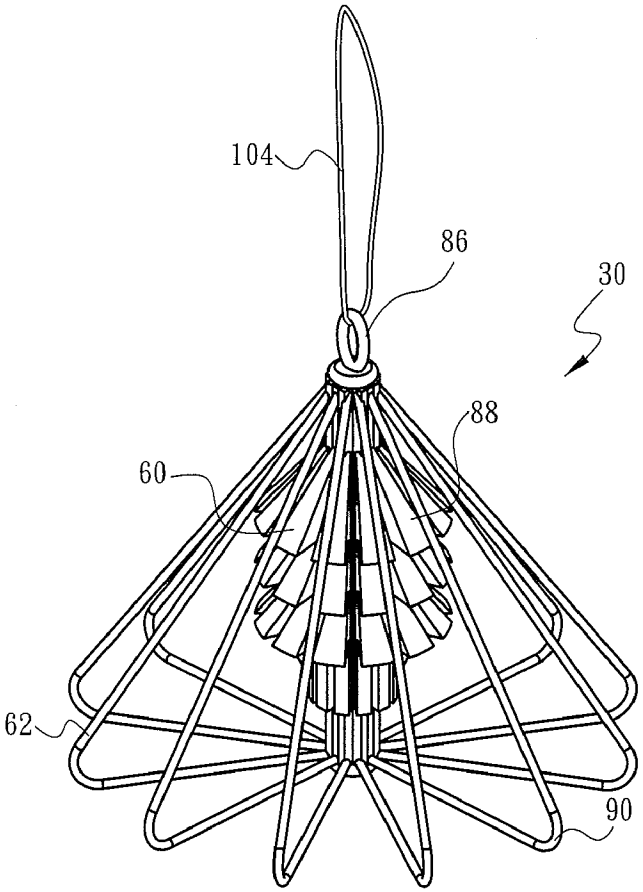
FIG. 10 shows a perspective view of a decoration according to a fourth embodiment of the present invention.
Figure 9:
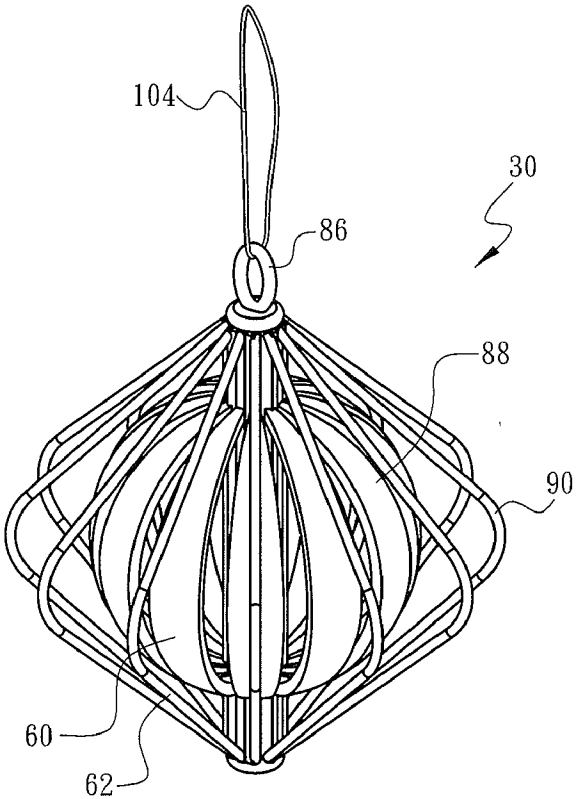
FIG. 9 shows a perspective view of a decoration according to a third embodiment of the present invention.
Figure 12:
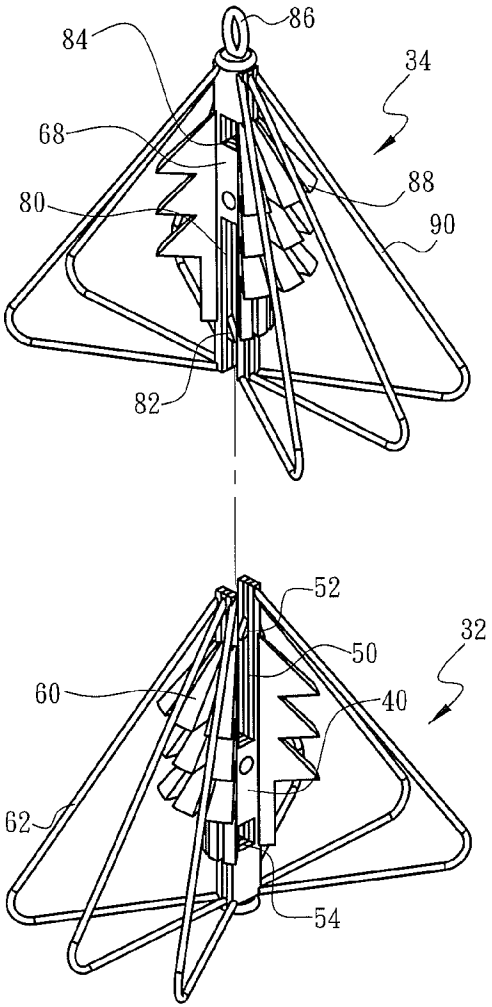
FIG. 12 is a partially exploded perspective view of the decoration of FIG. 10.
Figure 11:
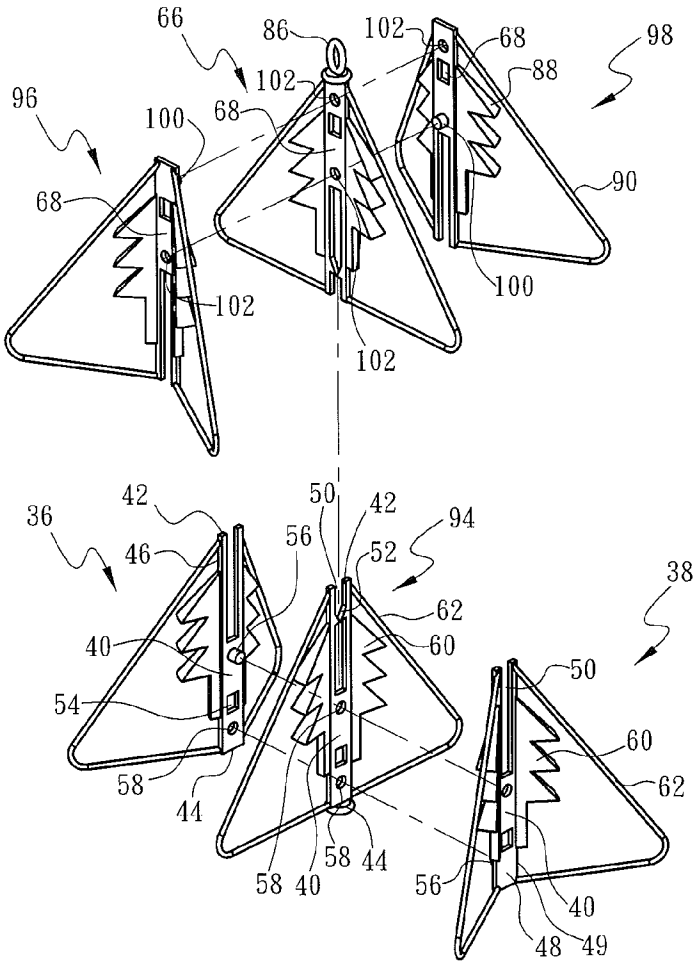
FIG. 11 is an exploded perspective view of the decoration of FIG. 10.
Figure 14:
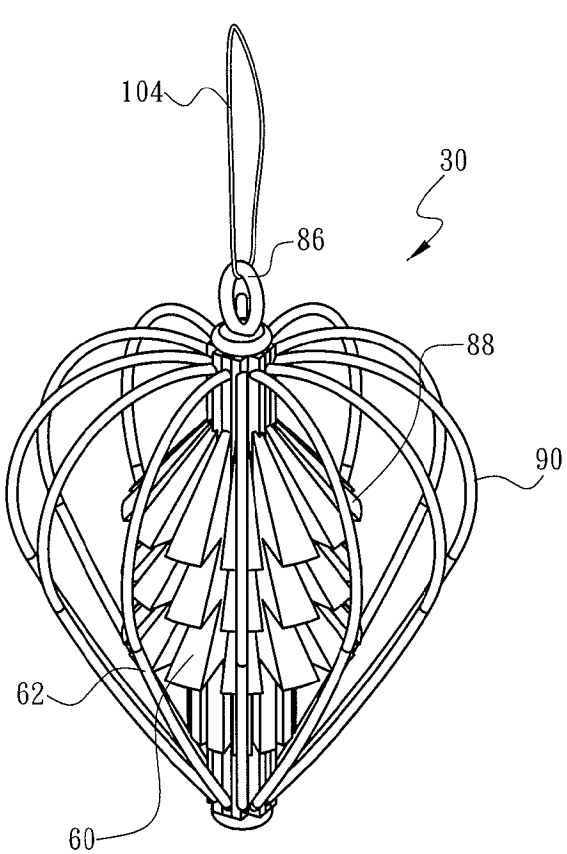
FIG. 14 shows a perspective view of a decoration according to a sixth embodiment of the present invention.
Figure 13:
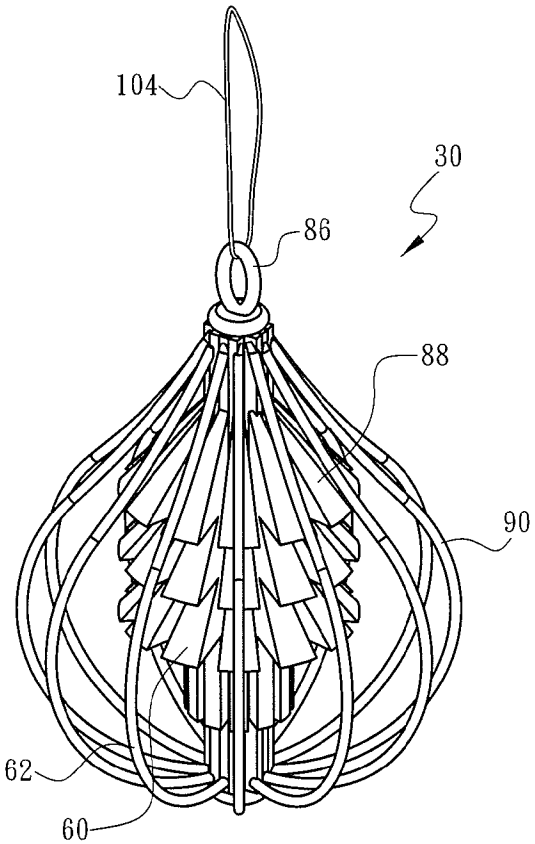
FIG. 13 shows a perspective view of a decoration according to a fifth embodiment of the present invention.

Now that the basic teachings of the present invention have been explained, many extensions and variations will be obvious to one having ordinary skill in the art. The decoration 30 shown in FIG. 9 is a modification of that shown in FIGS. 6 through 8, wherein second lower branch portion 62 and second upper branch portion 90 of decoration 30 does not include beads 64, 92. Further, referring to FIGS. 10 through 12, a decoration 30 of a fourth embodiment of the present invention is shown. In the embodiment, decoration 30 includes lower and upper decoration units 32 and 34 that are similar to lower and upper decoration units 32 and 34 in second embodiment. Description of the parts of decoration 30 shown in FIGS. 10 through 12 identical to those shown in FIGS. 6 through 8 is omitted. In particular, first lower branch portion 60 and first upper branch portion 88 respectively form the shape of a Christmas tree, and second lower branch portion 62 and second upper branch portion 90 respectively form triangular shape. In addition, the inner surfaces of clamp walls 51 of first and second lower decoration members 36 and 38 are not provided with locking blocks 52, and the inner surfaces of clamp walls 81 of second and third upper decoration members 96 and 98 are not provided with locking blocks 82. Further, The decorations 30 shown in FIG. 13 and FIG. 14 are modifications of that shown in FIG. 10, wherein second lower branch portions 62 and second upper branch portions 90 respectively form a water drop shape and an onion shape appearance.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

The invention claimed is:

1. A decoration, comprising, in combination:

a lower decoration unit including first and second lower decoration members, with each of the first and second lower decoration members including a lower main body having upper and lower ends spaced in a vertical direction, with the lower main body further including first and second surfaces spaced in a thickness direction perpendicular to the vertical direction, and two side surfaces spaced in a horizontal direction perpendicular to the vertical and thickness directions, with the lower main body further including a lower engaging slot extending from the upper end of the lower main body toward but spaced from the lower end of the lower main body so that the upper end of the lower main body is formed with two spaced clamp walls, with the first surface of the lower main body of the first lower decoration member being detachably connected with the first surface of the lower main body of the second lower decoration member, with each of the first and second lower decoration members further including at least one first lower branch portion extending outwards from one of the side surfaces of the lower main body; and an upper decoration unit including a first upper decoration member having upper and lower ends spaced in the vertical direction, first and second surfaces spaced in the thickness direction, and two side surfaces spaced in the horizontal direction, with the upper main body including an upper engaging slot extending from the lower end of the upper main body toward but spaced from the upper end of the upper main body so that the lower end of the upper main body is formed with two spaced clamp walls, with the first upper decoration member further including at least one first upper branch portion extending outwards from one of the side surfaces of the upper main body;

wherein the clamp walls of the first upper decoration member clamp on the second surface of the lower main bodies of the first and second lower decoration members, and the clamp walls of the first and second lower decoration members clamp on the first and second surfaces of the upper main body of the first upper decoration member.

2. The decoration according to claim 1, with the first surface of each of the first and second lower decoration members being provided with male and female engaging portions located between the lower end and the lower engaging slot of the lower main body of each of the first and second lower decoration members, and with the male and female engaging portions of the first lower decoration member respectively aligned and engaged with the female and male engaging portions of the second lower decoration member.

3. The decoration according to claim 2, with each of the two clamp walls of each of the first and second lower decoration members including an inner surface provided with a locking block, with the lower main body of each of the first and second lower decoration members further including a locking slot, with each of the two clamp walls of the first upper decoration member including an inner surfaces provided with a locking block engaged with one of the locking slots of the first and second lower decoration members, and with the upper main body further including a locking slot engaged with the locking blocks of the first and second lower decoration members.

4. The decoration according to claim 3, with each of the first and second lower decoration members further including at least one second lower branch portion extending outwards from the lower main body and located at an external side of the first lower branch portion, and with the first upper decoration member further including at least one second upper branch portion extending outwards from the upper main body in the horizontal direction.

5. The decoration according to claim 4, with each of the first and second lower decoration members including two first lower branch portions spaced by about 120 degrees and two second lower branch portions spaced by about 120 degrees, and with the first upper decoration member including two first upper branch portions spaced by 180 degrees and two second upper branch portions spaced by 180 degrees.

6. The decoration according to claim 2, with the lower decoration unit further including a third lower decoration member, and the upper decoration unit further including second and third upper decoration members, with the third lower decoration member being detachably connected between the first and second lower decoration members, with the third lower decoration member including a lower main body having upper and lower ends spaced in the vertical direction, and a lower engaging slot extending from the upper end of the lower main body toward but spaced from the lower end of the lower main body so that the upper end of the lower main body is formed with two spaced clamp walls, with the second and third upper decoration members being respectively connected on the first and second surfaces of the first upper decoration member, with each of the second and third upper decoration members including an upper main body having upper and lower ends spaced in the vertical direction, and an upper engaging slot extending from the lower end of the upper main body toward but spaced from the upper end of the upper main body so that the lower end of the upper main body is formed with two spaced clamp walls.

7. The decoration according to claim 6, with the lower main body of the third lower decoration member provided with two female engaging portions, with the male engaging portions of the first and second lower decoration members extending through and engaged in the female engaging portions of the third lower decoration member, with each of the second and third upper decoration members being provided with male and female engaging portions, and with the first upper decoration member being provided with two female engaging portions respectively aligned and engaged with the male engaging portions of the second and third upper decoration members.

8. The decoration according to claim 7, with each of the two clamp walls of each of the first, second, and third lower decoration members including an inner surface provided with a locking block, with the lower main body of each of the first, second, and third lower decoration members further including a locking slot, with each of the two clamp walls of each of the first, second, and third upper decoration members including an inner surface provided with a locking block respectively engaged with one of the locking slots of the first, second, and third lower decoration members, and with the upper main body further including a locking slot engaged with the locking blocks of the first, second, and third lower decoration members.

9. The decoration according to claim 8, with each of the first, second, and third lower decoration members further including at least one first lower branch portion extending outwards from the lower main body and at least one second lower branch portion extending outwards from the lower main body and located at an external side of the first lower branch portion, and with each of the first, second, and third upper decoration members further including at least one first lower branch portion extending outwards from the lower main body and at least one second upper branch portion extending outwards from the upper main body in the horizontal direction.

10. The decoration according to claim 9, with the second lower decoration members and the second upper decoration members provided with a plurality of beads respectively.

* * * * *